US009252522B2

(12) United States Patent
Akagi

(10) Patent No.: US 9,252,522 B2
(45) Date of Patent: Feb. 2, 2016

(54) LOCKING MECHANISM FOR MOLDED RESIN COMPONENT

(71) Applicant: YAZAKI CORPORATION, Tokyo (JP)

(72) Inventor: Yosuke Akagi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/420,954

(22) PCT Filed: Sep. 4, 2013

(86) PCT No.: PCT/JP2013/073775
§ 371 (c)(1),
(2) Date: Feb. 11, 2015

(87) PCT Pub. No.: WO2014/038581
PCT Pub. Date: Mar. 13, 2014

(65) Prior Publication Data

US 2015/0222042 A1 Aug. 6, 2015

(30) Foreign Application Priority Data

Sep. 7, 2012 (JP) ..... 2012-197733

(51) Int. Cl.
*H01R 13/436* (2006.01)
*H01R 13/46* (2006.01)
*H01R 13/62* (2006.01)

(52) U.S. Cl.
CPC ..... *H01R 13/4362* (2013.01); *H01R 13/46* (2013.01); *H01R 13/62* (2013.01); *Y10T 403/608* (2015.01)

(58) Field of Classification Search
CPC ..... H01R 13/4223; H01R 13/4362; H01R 13/6272; H01R 13/6275; H01R 13/4365; H01R 13/4361
See application file for complete search history.

(56) References Cited

U.S. PATENT DOCUMENTS 5,562,500 A * 10/1996 Tsukakoshi ..... H01R 13/4362 439/752
5,788,527 A * 8/1998 Sanders ..... H01R 13/6272 439/352
6,648,699 B1 * 11/2003 Makino ..... H01R 13/4362 439/595

FOREIGN PATENT DOCUMENTS

JP 08-078085 A 3/1996
JP 2008-505293 9/2008
JP 2010-040366 A 2/2010

(Continued)

OTHER PUBLICATIONS

International Preliminary Report on Patentability and English language Written Opinion of the International Search Report for PCT/JP2013/073775.

(Continued)

*Primary Examiner* — Gary Paumen
(74) *Attorney, Agent, or Firm* — Kenealy Vaidya LLP

(57) ABSTRACT

A second wall (34) has an opening (48). When an engagement projection (64) has climbed the inclined surface (43*a*) of a lock projection (43) and is going to reach the top of the lock projection, the opening allows a pressing projection (65) to be slide contacted with its edge (48*a*) while pressing the edge, thereby giving a lock arm a pressing force opposite to the deflecting direction thereof.

3 Claims, 7 Drawing Sheets

(56) References Cited

FOREIGN PATENT DOCUMENTS

| | | | |
|---|---|---|---|
| JP | 2010-050018 | A | 3/2010 |
| JP | 2013-008572 | A | 1/2013 |
| JP | 2013-025959 | A | 2/2013 |
| JP | 2013-101869 | A | 5/2013 |
| JP | 2013-101870 | A | 5/2013 |
| JP | 2013-105658 | A | 5/2013 |
| WO | WO2012/176898 | A1 | 12/2012 |
| WO | WO2013/012052 | A1 | 1/2013 |
| WO | WO2013/069336 | A1 | 5/2013 |
| WO | WO2013/069337 | A1 | 5/2013 |
| WO | WO2013/073228 | A1 | 5/2013 |

OTHER PUBLICATIONS

International Search Report and Written Opinion of the International Search Report for PCT/JP2013/073775 dated Nov. 12, 2013.

* cited by examiner

LOCKING MECHANISM FOR MOLDED RESIN COMPONENT

TECHNICAL FIELD

The present invention relates to a locking mechanism which, when combining two resin molded parts, locks them in a manner to prevent them against separation from each other, for example, a locking mechanism to be applied between a connector housing and a double locking spacer (which is called also a retainer) of a terminal.

BACKGROUND

The patent document 1 discloses a connector in which, in order to double lock a terminal inserted into a terminal housing chamber of a connector housing together with a lance formed within such chamber, a spacer is inserted orthogonally to the terminal insertion direction to restrict the movement of the terminal.

Between the spacer and connector housing of this type, there is interposed a locking mechanism which, when the spacer is inserted, locks the spacer to prevent it against removal. As this type locking mechanism, there is known a mechanism using a combination of a lock projection provided in one of the connector housing and spacer and a lock arm provided in the other.

In a certain mechanism, a spacer includes, on its two side portions, elastic wall-like portions serving as lock arms each having an engagement projection on its deflecting-direction side surface and, by engaging the engagement projections with lock projections provided on the inner wall of the spacer housing space of a connector housing, their locking can be attained (see the patent document 1).

The above-structured locking mechanism includes the following locking mechanism (see the patent document). That is, in this locking mechanism, two opposed walls across the lock arm are provided in the spacer housing space of the connector housing. On the first wall of the two walls, there is provided a lock projection engageable with an engagement projection provided on one side surface of the lock arm. Also, on the other side surface of the lock arm, there is provided a pressing projection which, when the lock arm deflects, presses the second wall of the two walls. The pressing projection applies to the lock arm a pressing force oppositely to the deflecting direction when the engagement projection of the lock arm overruns the lock projection. This can enhance the substantial flexural rigidity of the lock arm.

CITATION LIST

Patent Literature

[Patent Document 1] JP A No. 2010-40366
[Patent Document 2] Japanese Invention Association Technology Publication No. 2008-505293

SUMMARY OF INVENTION

Technical Problem

Like the locking mechanism of the patent document 2, when the pressing projection is provided in the lock arm separately from the engagement projection such that it can interfere with the second wall with deflection of the lock arm, the pressing projection is simply slide contacted with the second wall while pressing it with insertion of the spacer, whereby only a friction force is generated between the pressing projection and second wall as insertion resistance. That is, since, when the engagement projection of the lock arm overruns the lock projection, with increased deflection of the lock arm, an elastic restoring force and a frictional force simply increase, the lock arm and lock projection are engaged with the insertion resistance not changed much. Therefore, relatively weak lock attainment feeling is given to the hand of an operator. Also, since the spacer insertion force is not so large, there is a possibility of the spacer being removed on transportation or the like.

The invention is made in view of the above circumstances and thus its object is to provide a resin molded parts locking mechanism which can give strong lock attainment feeling and also can enhance a part removal preventive effect on transportation or the like.

Solution to Problem

The above object of the invention is attained by the following structures.

(1) A resin molded parts locking mechanism, comprising: a lock projection provided on a first part and a lock arm provided on a second part to be combined with the first part, whereby, by moving the second part in a specific straight line direction with respect to the first part, the lock arm is engaged with the lock projection, wherein the lock arm is formed as a cantilever-like elastic arm which has a fixed rear end in the moving direction of the second part with respect to the first part and a free front end in the moving direction, can be deflected in a direction orthogonal to the moving direction, and also has, at a position on the free end side on one side surface in the deflecting direction, an engagement projection engageable with the lock projection; the first part has a first wall surface extending along the moving direction of the lock arm to cross orthogonally the deflecting direction of the lock arm, being opposed to one side surface in the deflecting direction of the lock arm, and having the lock projection; the lock projection has, in its front surface opposed to the moving direction of the lock arm, an inclined surface which, when the engagement projection of the lock arm climbs it with the movement of the second part, deflects the lock arm gradually in a direction to part away from the first wall surface, and, in its back surface opposed to the front surface, a lock wall which, when the engagement projection overruns the top of the lock projection and the lock arm returns from its deflected state to its initial position, is opposed to and engaged with the lock wall of the engagement projection of the lock arm, thereby preventing the second part from moving oppositely to the moving direction; the first part has a second wall surface opposed to the first wall surface across the lock arm; the lock arm also has, between the engagement projection on the other side surface in the deflecting direction and the fixed end, a pressing projection which, when the engagement projection of the lock arm climbs the inclined surface of the lock projection and the lock arm is thereby deflected in a direction to part from the first wall surface, presses the second wall to give the lock arm a pressing force opposite to the deflection direction, thereby enhancing the substantial flexural rigidity of the lock arm; and, the second wall has an opening which, when, with movement of the second part, the engagement projection of the lock arm starts to climb the inclined surface of the lock projection to thereby start to deflect the lock arm in a direction to approach the second wall surface, stores the pressing projection therein and, when, with further movement of the second part, the engagement projection of the lock arm has climbed the inclined surface of the lock projection and is going to reach the top of the lock projection, allows the pressing projection to be slide contacted with its opening edge while pressing the edge, thereby giving the lock arm a pressing force opposite to the deflecting direction.

(2) A resin molded parts locking mechanism according to the item (1), wherein the first part is a connector housing, and the second part is a spacer for locking a terminal inserted into the terminal housing chamber of the connector housing; the spacer can be inserted orthogonally to the insertion direction of the terminal into the terminal housing chamber; the connector housing secures the housing space for the spacer; the housing space has, in a portion thereof, an insertion space having the first wall surface and second wall surface as opposed walls for inserting the lock arm; the first wall surface is formed inside the insertion space, whereas the second wall surface is formed outside the insertion space; and, the first wall surface includes, as the above lock projection, a lock projection for locking the spacer in a position for restricting the insertion-direction movement of the terminal, and, in front of the lock projection in the insertion direction of the lock arm, a temporary lock projection, when engaged with the engagement projection of the lock arm, for locking the spacer temporarily in a position allowing the insertion-direction movement of the terminal.

(3) A resin molded parts locking mechanism according to the above item (2), wherein the opening is formed at a position capable of visually confirming, through the opening, the pressing projection of the lock arm temporarily locked.

In the locking mechanism according to the item (1), when, with movement of the second part relative to the first part, the engagement projection of the lock arm starts to climb the inclined surface of the lock projection, as it climbs, the lock arm increases its deflection. Therefore, a force necessary for moving the second part (which is hereinafter called an insertion force or insertion resistance) is increased by a component force generated by the elastic restoring force of the lock arm in the moving direction of the second part and a friction force generated when the engagement projection of the lock arm climbs the inclined surface of the lock projection. Also, when, with further deflection of the lock arm, the pressing projection of the lock arm starts to interfere with the second wall surface, a friction force between the pressing projection and second wall surface is also added to the insertion resistance. With increased deflection of the lock arm, the pressing force between the second wall surface and pressing projection increases to strongly press the lock arm oppositely to the deflecting direction. The increased pressing force increases the friction force and the component force in the moving direction, thereby increasing the insertion force of the second part.

When the second wall surface has no opening, the pressing projection simply slide moves along the second wall surface while pressing it, thereby generating only a friction force between the pressing projection and second wall surface. Meanwhile, when the second wall surface has an opening, after the pressing projection is once engaged into the opening, it climbs up to the second wall surface while interfering with the edge of the opening. Thus, catch resistance larger than the frictional force reaches its instantaneous peak and is added to the insertion resistance of the second part.

Therefore, in the locking mechanism having the structure of the item (1), an operator engages the lock arm with the lock projection against the large insertion resistance varying in a peak manner. Thus, the operator can feel large insertion force variations on his or her hand pressing and moving the second part and thus can confirm lock attainment through such feeling more easily. Also, the increased insertion resistance can enhance the effect of preventing removal of the second part.

In the locking mechanism having the structure of the item (2), the insertion force can be increased not by a friction force between the pressing projection of the lock arm of the spacer and second wall surface but by catch resistance between the pressing projection and opening edge. The thus increased insertion force can enhance the spacer removal preventive effect.

In the locking mechanism having the structure of the item (3), the temporary lock state of the spacer can be visually confirmed from outside through the opening.

According to the invention, the feeling of lock attainment can be strongly impressed on the operator. Also, the increased insertion resistance can enhance the effect of preventing removal of parts on transportation and the like.

The invention has been described briefly heretofore. Further, when the mode (which is hereinafter called an embodiment) for enforcing the invention to be described below is read through with reference to the accompanying drawings, the details of the invention will be understood more clearly.

BRIEF DESCRIPTION OF DRAWINGS

FIG. 1 shows the structure of a connector employing a locking mechanism of an embodiment of the invention and is a diagrammatic perspective view, showing a state before a spacer as a second part is mounted into a connector housing as a first part.

FIG. 2 is a side view, when the spacer is mounted into the connector housing.

FIG. 3 is a side section view, showing the same state as FIG. 2.

FIG. 4 is a section view taken along the arrow line IV-IV of FIG. 2.

FIG. 7 is a characteristics view of difference in insertion force characteristics to insertion stroke between the embodiment of the invention (solid line) and comparison example (dotted line).

DESCRIPTION OF EMBODIMENTS

Description is given below of an embodiment of the invention with reference to FIGS. 1 to 6(*b*).

Figure 1:
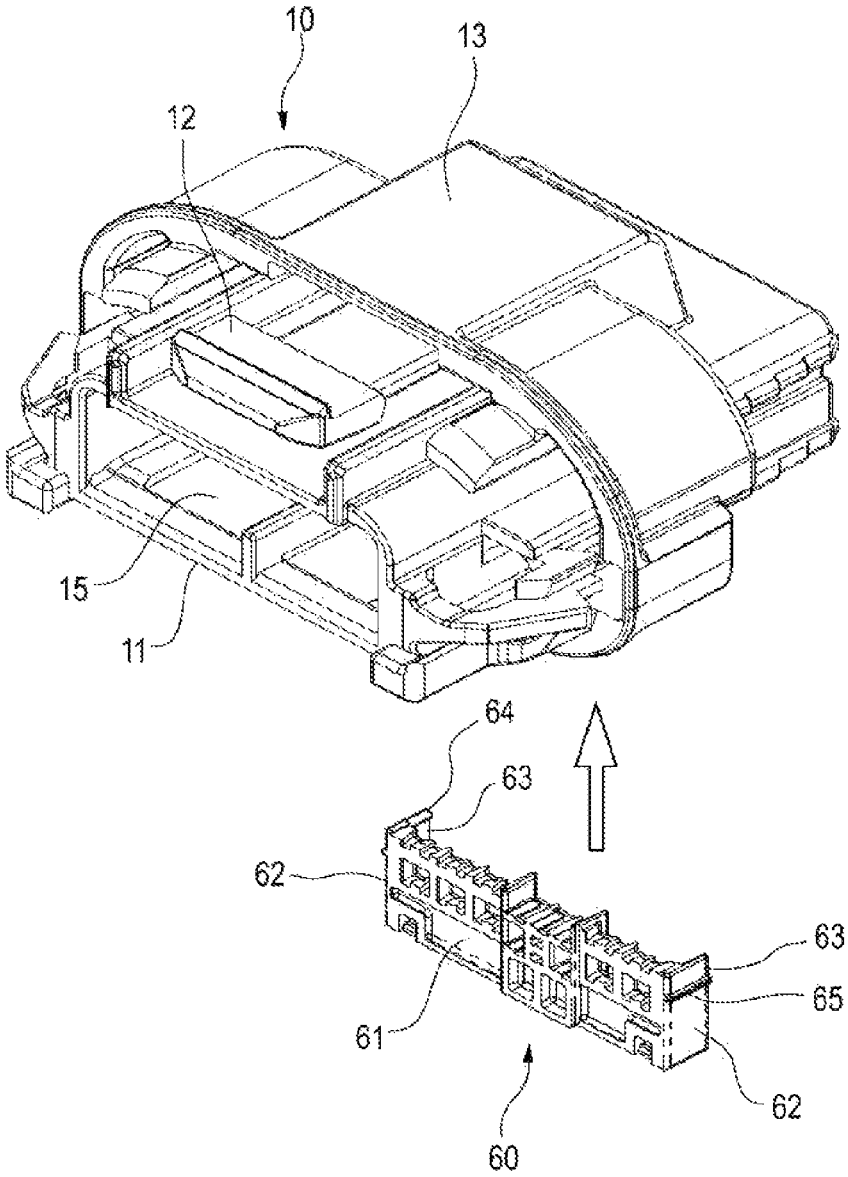
[FIG. 1 ]
Figure 2:
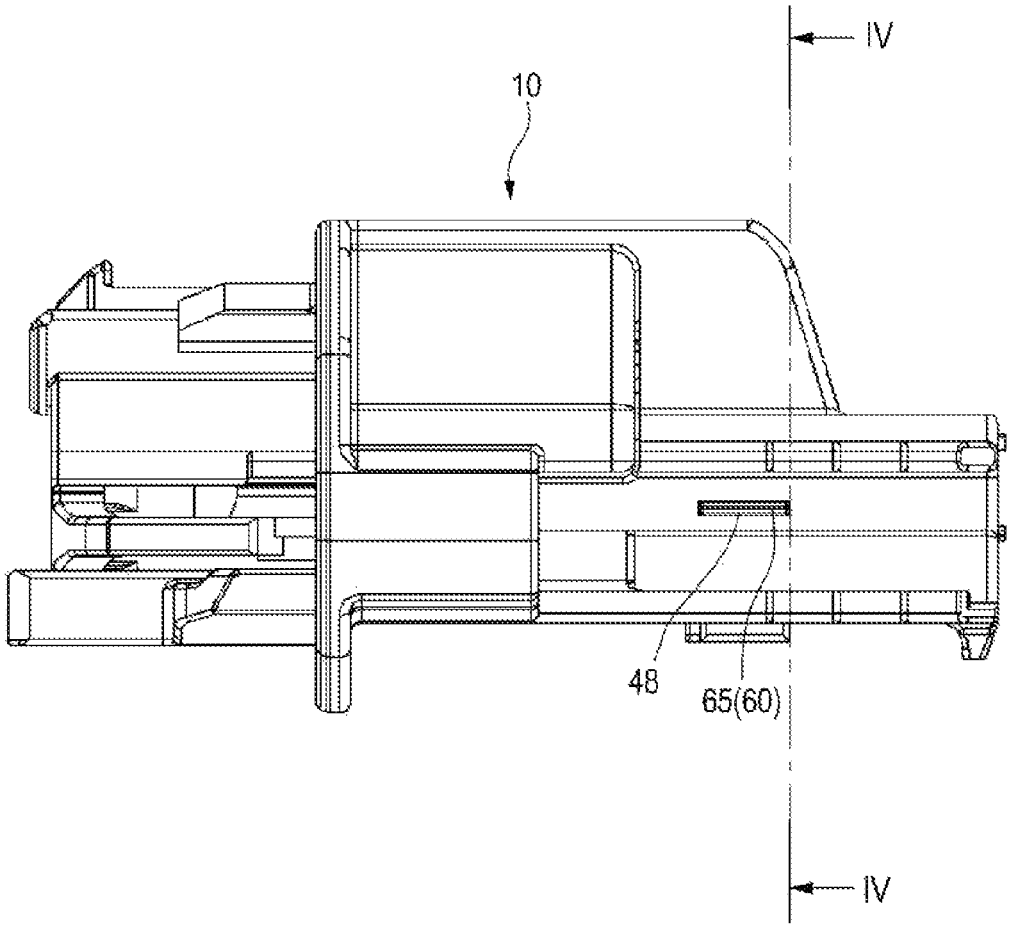
[FIG 2 ]
Figure 3:
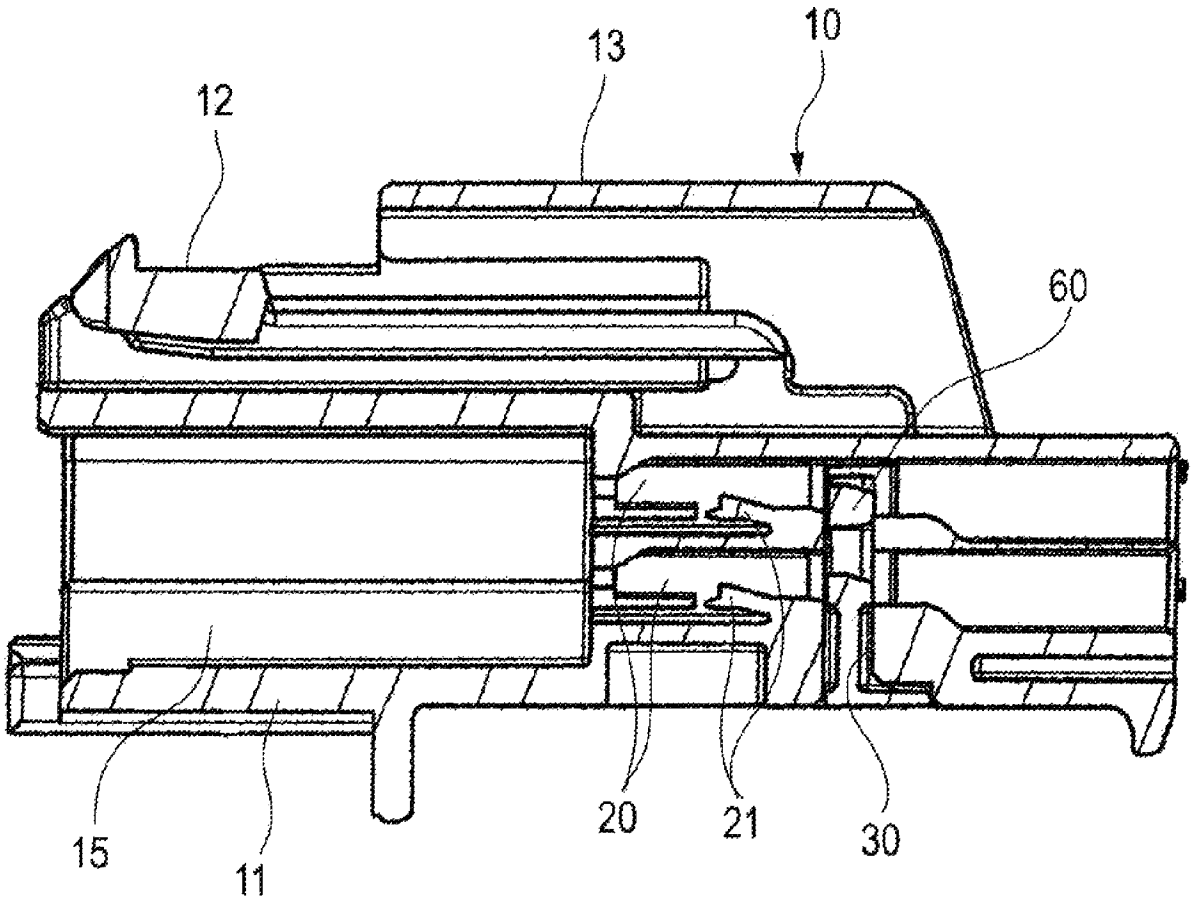
[FIG. 3 ]
Figure 4:
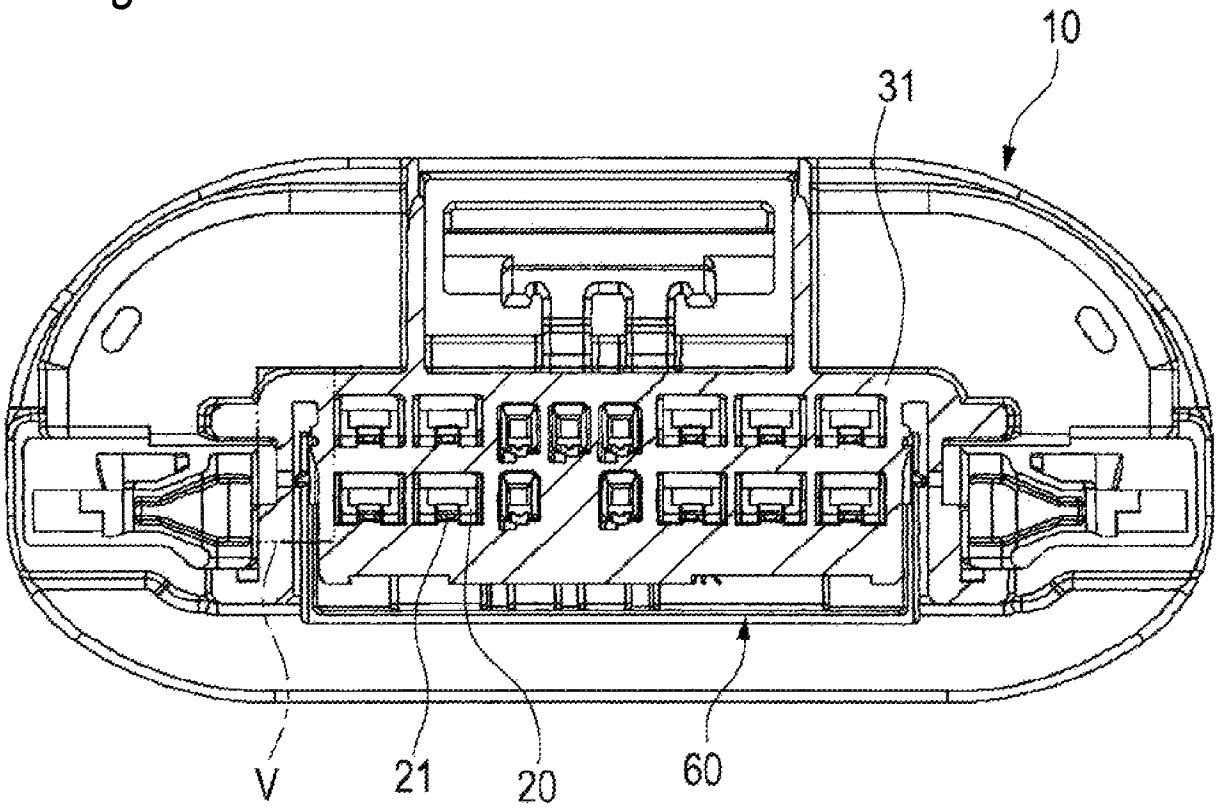
[FIG. 4 ]
Figure 5:
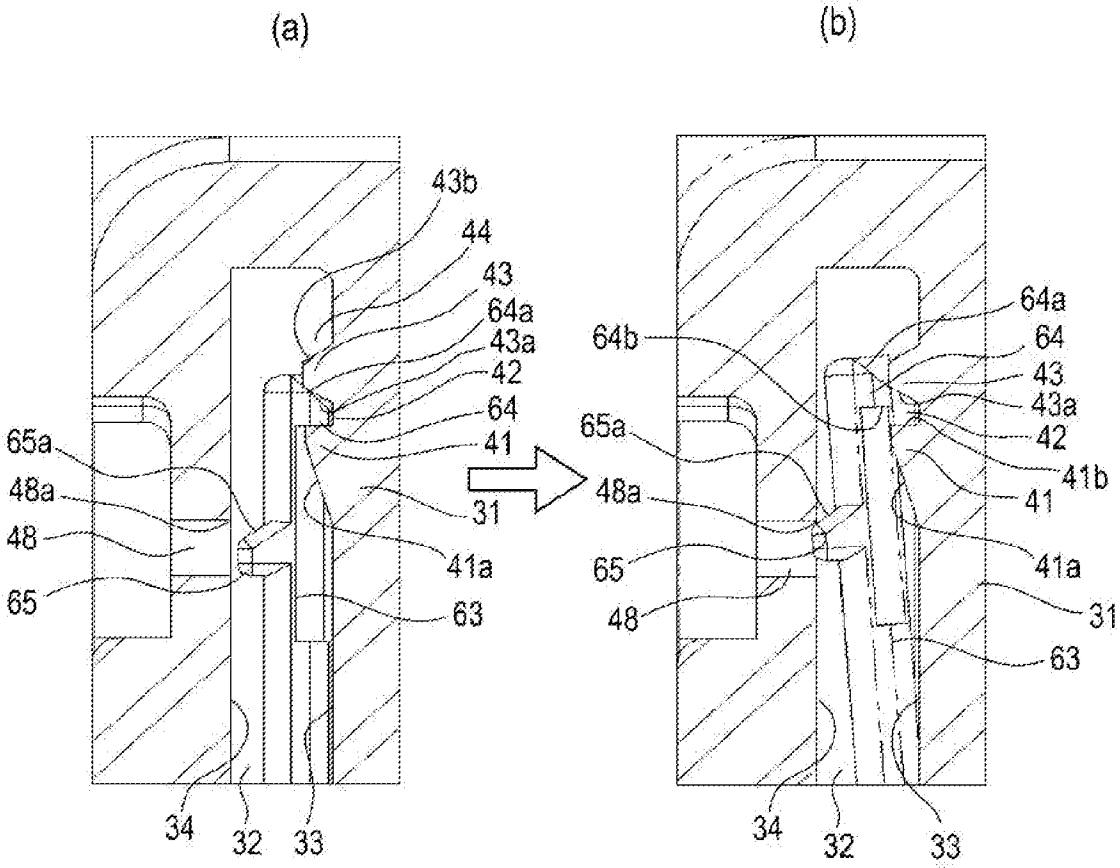
[FIG. 5 ]FIGS. 5(*a*) and 5(*b*) are enlarged views of the V portion of FIG. 4; specifically, FIG. 5(*a*) shows temporary locking and FIG. 5(*b*) shows when a pressing projection interferes with an opening on the way from temporary locking to locking.
Figure 6:
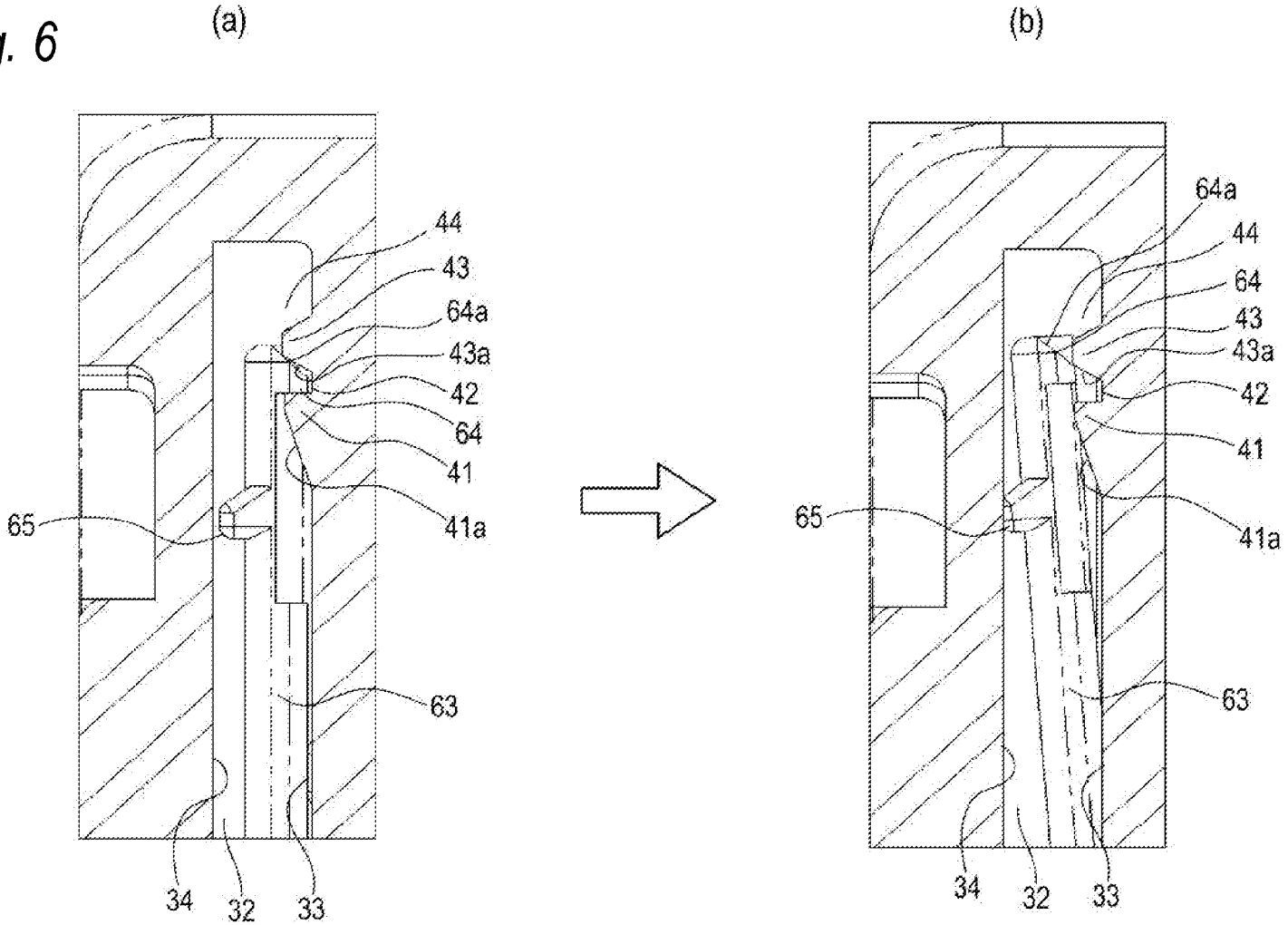
[FIG. 6 ]FIGS. 6(*a*) and 6(*b*) are views of a comparison example having no opening, similarly to FIG. 5; specifically, FIG. 6(*a*) shows temporary locking and FIG. 6(*b*) shows a state on the way from temporary locking to locking.

FIG. 1 shows the structure of a connector employing a locking mechanism according to an embodiment of the invention and is a diagrammatic perspective view, showing a state before a spacer 60 as a second part is mounted into a connector housing 10 as a first part. FIG. 2 is a side view, when the spacer 60 is mounted into the connector housing 10. FIG. 3 is a side section view, showing the same state as FIG. 2. FIG. 4 is a section view taken along the arrow line IV-IV of FIG. 2. FIGS. 5(*a*) and 5(*b*) are enlarged views of the V portion of FIG. 4; specifically, FIG. 5(*a*) shows temporary locking and FIG. 5(*b*) shows when a pressing projection 65 interferes with the opening edge 48*a* of an opening 48 on the way from temporary locking to locking. FIGS. 6(*a*) and 6(*b*) are views of a comparison example having no opening 48, similarly to FIG. 5; specifically, FIG. 6(*a*) shows temporarily locked state, and FIG. 6(*b*) shows a state on the way from temporary locking to locking.

As shown in FIGS. 1 to 4, the connector housing 10 used as a first resin molded part has a connector main body 11 including a cylindrical portion 15 in its front half portion and terminal housing chambers 20 in its rear half portion. The connector housing 10 also has an upper cover 13 arranged to cover the upper side of the axial-direction intermediate portion of the connector main body 11. The connector housing 10 further has a main lock arm 12 interposed between the connector main body 11 and upper cover 13 for locking with a counterpart connector.

Male terminals (not shown) are housed in the terminal housing chambers 20 of the connector main body 11, with their leading ends protruding into the cylindrical portion 15. Terminals inserted from behind the connector housing 10 are primarily locked by lances 21 provided within the terminal housing chambers 20. With the male terminals primarily locked, when the spacer 60 is inserted into a spacer housing space 30 so formed on the lower surface side of the wall-like portion 31 of the connector main body 11 as to penetrate through the terminal housing chambers 20, the male terminals are secondarily locked (in other words, double locked).

In the spacer 60 used as the second resin molded part, as shown in FIG. 1, plate-shaped lock arms are integrally formed on the right and left side walls 62 of a spacer main body 61. This spacer 60 can be inserted into the spacer housing space 30 orthogonally (that is, vertically) to the terminal insertion direction (that is, the longitudinal direction of the housing 10) into the terminal housing chamber 20. The spacer 60, while held at its temporary lock position, allows the insertion and removal of the terminals and, when it is inserted from the temporary lock position more deeply to its lock position, it double locks the terminals.

As shown in FIG. 5, the locking mechanism of the embodiment includes a lock projection (a lock projection 43 to be described later) provided on the connector housing 10 (see FIG. 1) and a lock arm 63 provided on the spacer 60 (see FIG. 1). By inserting the spacer 60 into the spacer housing space 30 (see FIG. 3) of the connector housing 10 linearly upward from below, the engagement projection 64 of the lock arm 63 can be engaged with the lock projection (that is, the lock position 43).

In the lock arm 63, its spacer 60 insertion direction (that is, moving direction) rear end (that is, lower end) is formed as a fixed end, while the insertion direction front end (that is, upper end) is formed as a free end. The lock arm 63 is formed as a cantilever-like elastic arm deflectable in the right and left direction orthogonal to the insertion direction. In this embodiment, the lock arms 63 are provided successively in the right and left side walls 62 of the spacer main body 61. The front end of the lock arm 63 is not completely deflected with the rear end as the fulcrum but, basically, its front end side (that is, upper end side) is deflected with its rear end side (that is, lower end side) as the fulcrum.

In the two right and left side portions of the spacer housing space 30 of the connector housing 10, there is formed an insertion space 32 for the lock arm 63. The insertion space 32 has two opposed wall surfaces, that is, a first wall surface 33 situated inside and a second wall surface 34 situated outside. The inside first wall surface 33 and the outside second wall surface 34 of the insertion space 32 are surfaces extending along the insertion direction of the lock arm 63 orthogonally to the deflecting direction of the lock arm 63. The inside surface of the lock arm 63 constituting one of the deflecting-direction side surfaces of the lock arm 63 is opposed to the first wall surface 33, and the outside surface of the lock arm 63 constituting the other side surface is opposed to the second wall surface 34.

The first wall surface 33 includes a lock projection 43 serving as the lock projection and a temporary lock projection 41 for holding the spacer 60 at a temporary lock position. The lock arm 63 includes, at a position on the arm free end side (that is, upper end side) on the inside surface (that is, one deflection-direction side surface) thereof, an engagement projection 64 engageable with the lock projection 43 and temporary lock projection 41.

The lock projection 43 actually locks the spacer 60 at the lock position for restricting the insertion-direction movement of the terminal. The temporary lock projection 41 is provided in front of (that is, below) the lock projection 43 in the insertion direction of the lock arm 63. The temporary lock projection 41, when engaged with the engagement projection 64 of the lock arm 63, temporarily locks the spacer 60 at a temporary lock position allowing the insertion direction movement of the terminal.

Between the lock projection 43 and temporary lock projection 41, there is formed an engagement recess 42 engageable with the engagement projection 64 of the lock arm 63 in temporary locking. Also, an engagement recess 44 for storing the engagement projection 64 in locking is formed on the deeper side of the lock projection 43.

The lock projection 43 has, on its front surface facing the moving direction of the lock arm 63, an inclined surface 43*a* onto which, with insertion of the spacer 60, the engagement projection 64 of the lock arm 63 climbs it to thereby deflect the lock arm 63 in a direction to part from the first wall surface 33. The lock projection 43 also has, on its back surface opposed to the front surface, a lock wall 43*b* which, when the engagement projection 64 overruns the top of the lock projection 43 and thus the lock arm 63 returns from its deflected state to its initial position, can be opposed to and engaged with a lock wall 64*b* on the rear surface of the engagement projection 64 of the lock arm 63. When the lock wall 43*b* is engaged with the lock wall 64*b*, the movement of the spacer 60 in a direction opposite to the insertion direction (that is, in a removing direction) is prevented.

The temporary lock projection 41 has, on its front surface facing the moving direction of the lock arm 63, an inclined surface 41*a* on which, with insertion of the spacer 60, the engagement projection 64 of the lock arm 63 climbs it to thereby deflect the lock arm 63 in a direction to part from the first wall surface 33. The lock projection 41 also has, on its back surface opposed to the front surface, a lock wall 42*b* which, when the engagement projection 64 overruns the top of the temporary lock projection 41 and thus the lock arm 63 returns from its deflected state to its initial position, can be opposed to and engaged with the lock wall 64*b* on the rear surface of the engagement projection 64 of the lock arm 63. When the lock wall 42*b* is engaged with the lock wall 64*b*, the movement of the spacer 60 in a direction opposite to the insertion direction (that is, in a removing direction) is prevented.

The insertion-direction front surface of the engagement projection 64 of the lock arm 63 is formed as an inclined surface 64*a* so that it can easily overrun the lock projection 43 and temporary lock projection 41.

The lock arm 63 also has a pressing projection 65 between its fixed end and the engagement projection 64 on its outside surface (that is, the other of the deflecting-direction side surfaces). When the engagement projection 64 of the lock arm 63 climbs the inclined surface 43*a* of the lock projection 43 to thereby deflect the lock arm 63 in a direction to part from the first wall surface 33, the pressing projection 65 presses the second wall surface 34. Accordingly, a pressing force in a direction opposite to the deflecting direction (that is, in an inward direction) is applied to the lock arm 63. Thus, the pressing projection 65 enhances the substantial flexural rigidity of the lock arm 63.

In the second wall surface 34, as shown in FIG. 5(*b*), there is formed an opening 48. When, with insertion of the spacer 60, the engagement projection 64 of the lock arm 63 starts to climb the inclined surface 43*a* of the lock projection 43 and thus the lock arm 63 starts to deflect in a direction to approach the second wall surface 34, the opening 48 stores the pressing projection 65 therein. When, with further insertion of the spacer 60, the engagement projection 64 of the lock arm 63 has climbed the inclined surface 43*a* of the actual lock projection 43 and is going to reach the top of the lock projection 43, the front side inclined surface 65*a* of the pressing projection 65 is pressed against and slide contacted with the edge 48*a* of the opening 48, whereby the opening 48 gives the lock arm 63 a pressing force opposite to the deflecting direction. In this case, the opening 48 is formed at a position allowing visual confirmation of the pressing projection 65 of the temporarily locked lock arm 63 from outside through the opening 48.

Here, as shown in FIG. 5(*a*), the height of the pressing projection 65 is set such that, when the lock arm 63 is not deflected but is situated in the initial position, the pressing projection 65 is separated from the second wall surface 34.

Next, description is given of the operation.

When the spacer 60 is inserted upward from below into the spacer housing space 30 opened in the lower surface of the connector housing 10, with this insertion, the engagement projection 64 of the lock arm 63 climbs the inclined surface 41 a of the temporary lock projection 41. Since the lock arm 63 increases its deflection as the projection 64 climbs, an insertion force necessary for inserting the spacer 60 (that is, insertion resistance) is increased by a component force caused by the elastic restoring force of the lock arm 63 in the insertion direction of the spacer 60 and a friction force generated when the engagement projection 64 of the lock arm 63 climbs the inclined surface 41 a of the temporary lock projection 41.

When, with further deflection of the lock arm 63, the pressing projection 65 of the lock arm 63 starts to interfere with the second wall surface 34, a friction force generated between the pressing projection 65 and second wall surface 34 is also added to the insertion resistance. As the lock arm 63 increases its deflection, a pressing force between the second wall surface 34 and pressing projection 65 increases, whereby the lock arm 63 is strongly pressed oppositely to the deflecting direction. Thus, such increased pressing force increases the friction force and a component force in the insertion direction, thereby increasing the insertion force of the spacer 60.

And, when the engagement projection 64 of the lock arm 63 overruns the top of the temporary lock projection 41, the lock arm 63 returns from its deflected position to the initial position, whereby the engagement projection 64 is engaged into the engagement recess 42. Thus, the temporary lock state is held. In this temporary lock state, the terminal can be inserted into the connector housing 10.

When the spacer 60 is inserted further deeply from this state to the lock position, with insertion of the spacer 60, the engagement projection 64 of the lock arm 63 starts to climb the inclined surface 43*a* of the lock projection 43. Thus, since the lock arm 63 increases its deflection as the projection 64 climbs, the insertion force necessary to insert the spacer 60 (that is, insertion resistance) is increased by a component force generated by the elastic restoring force of the lock arm 63 in the spacer 60 insertion direction and a friction force produced when the engagement projection 64 of the lock arm 63 climbs the inclined surface 43*a* of the lock projection 43.

Although, with further deflection of the lock arm 63, the pressing projection 65 of the lock arm 63 is going to interfere with the second wall surface 34, since the opening 48 is formed at a position corresponding to the pressing projection 65, it is stored into the opening 48. Therefore, at this stage, no friction force is generated between the second wall surface 34 and pressing projection 65.

Like a comparison example shown in FIG. 6, with no opening 48 in the second wall surface 34 (see FIG. 5), the pressing projection 65, while pressing the second wall surface 34, slides along the second wall surface 34. Thus, between the pressing projection 65 and second wall surface 34, there is generated only the friction force. Meanwhile, in the embodiment shown in FIG. 5, since the opening 48 exists in the second wall surface 34, after the pressing projection 65 is once engaged into the opening 48, it climbs up to the second wall surface 34 while interfering with the edge 48*a* of the opening 48. Thus, catch resistance larger than the friction force is added to the insertion resistance of the spacer 60 in an instantaneous peak manner.

When the engagement projection 64 of the lock arm 63 overruns the top of the lock projection 43, the lock arm 63 returns from the deflected position to the initial position and the engagement projection 64 is engaged with the lock projection 43. Thus, locking is retained. In this locking, the terminal is double locked in the connector housing 10.

As described above, in the embodiment, an operator engages the lock arm 63 with the lock projection 43 against the large insertion resistance varying in a peak manner. Thus, since the operator can feel large insertion force variations on his or her hand inserting the spacer 60, the feeling can facilitate confirmation of the locking. Also, the increased insertion resistance can enhance the removal preventive effect of the spacer 60.

That is, since the insertion force can be increased not by friction between the pressing projection 65 of the lock arm 63 of the spacer 60 and second wall surface 34 but by catch resistance between the pressing projection 65 and the edge 48*a* of the opening 48, the removal preventive effect of the spacer 60 can be enhanced by the increased insertion force. Also, since the temporary lock state of the spacer 60 can be visually confirmed from outside through the opening 48, confirmation of the state of the connector can be facilitated.

Figure 7:
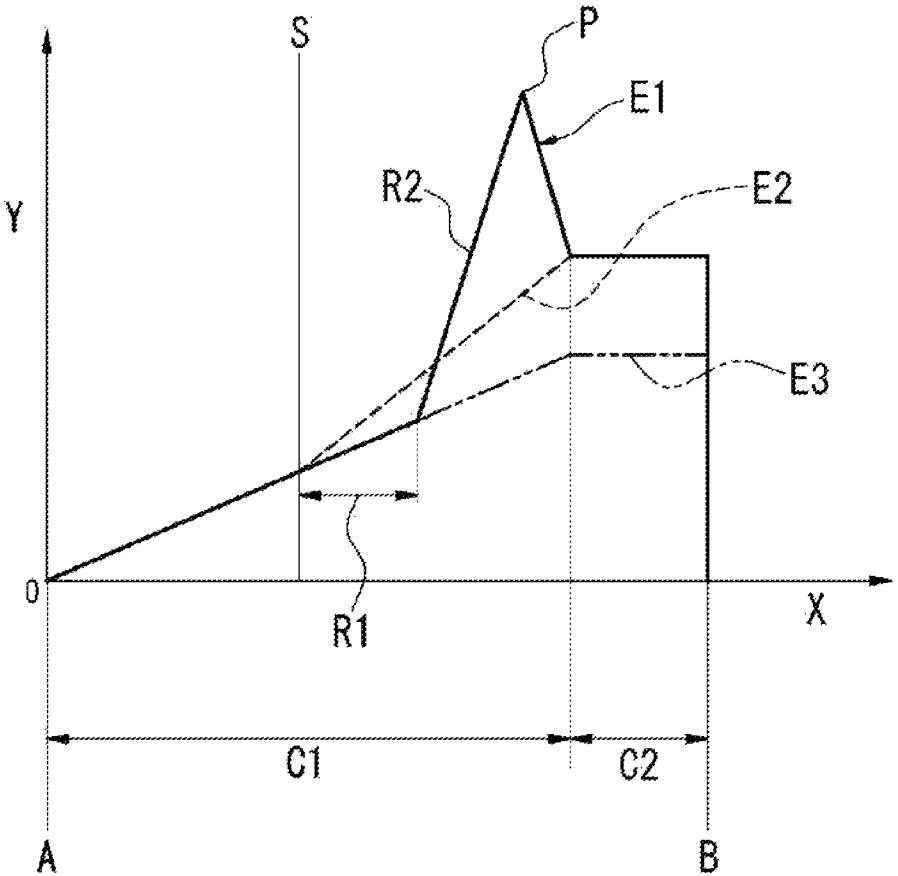
[FIG. 7 ]

FIG. 7 is a characteristic view to show difference in insertion force characteristics to insertion strokes between the embodiment of the invention (shown by a solid line) and the comparison example (dotted line). The embodiment includes the opening 48 as shown in FIG. 5, whereas the comparison example includes no opening as shown in FIG. 6.

In FIG. 7, the horizontal axis is an insertion stroke X and the vertical axis is an insertion force Y. A sign E1 shows the embodiment of the invention (that is, a case where an opening is included). A sign E2 shows the comparison example (that is, a case where no opening is included but only the frictional force is applied). A sign E3 shows a case where only the elastic restoring force of the lock arm 63 acts (that is, a case where the second wall surface 34 is not included). A sign A shows a temporary lock position and a sign B a lock position. A sign C1 shows a block where the engagement projection 64 of the lock arm 63 is climbing the inclined surface 43*a* of the lock projection 43 (climbing inclined surface), while a sign C2 shows a block where the engagement projection 64 has reached the top surface of the lock projection 43 (top surface).

A sign S shows a point where the pressing projection 65 starts to touch and interfere with the second wall surface 34. A sign R1 shows a block where the pressing projection 65 is stored in the opening 48 and no friction force acts. A sign R2 shows a block where the pressing projection 65 interferes with the edge 48*a* of the opening 48 and thus catch resistance is generated (climbing on opening edge).

Firstly, describing the comparison example (dotted line), when the insertion stroke of the spacer 60 changes from the temporary lock position to the lock position, until the pressing projection 65 starts to interfere with the second wall surface 34, only the elastic restoring force of the lock arm 63 influences the insertion force. Here, a friction force actually exists between the first wall surface 33 and engagement projection 64 but description thereof is omitted here. Meanwhile, when the pressing projection 65 starts to interfere with the second wall surface 34, a friction force between the second wall surface 34 and pressing projection 65 starts to influence the insertion force. When the engagement projection 64 reaches the top surface of the lock projection 43, the deflection direction force does not increase any further nor the friction force, whereby the locking is attained as it is.

Next, describing the embodiment (solid line), when the insertion stroke of the spacer 60 changes from the temporary lock position to the lock position, until the pressing projection 65 starts to interfere with the second wall surface 34, only the elastic restoring force of the lock arm 63 influences the insertion force. Here, a friction force actually exists between the first wall surface 33 and engagement projection 64 but description thereof is omitted here. Meanwhile, at a position where the pressing projection 65 starts to interfere with the second wall surface 34, the pressing projection 65 drops down into the opening 48, whereby no frictional force is generated during such dropping.

After then, just before reaching the top of the lock projection 43, the pressing projection 65 starts to interfere with the edge 48*a* of the opening 48. At this time, between the pressing projection 65 and opening 48, there is generated catch resistance larger than the friction force, thereby increasing the insertion force greatly and instantaneously. And, by inserting the spacer 60 further against the large insertion force, the pressing projection 65 climbs the second wall surface 34 from the edge 48*a*. At that stage, since the engagement projection 64 has reached the top surface of the lock projection 43, the deflection-direction force does not increase further nor the frictional force, whereby the locking is attained as it is.

As described above, since the peak of the insertion force can be increased, the operator can confirm the locking as a positive feeling.

Here, the invention is not limited to the above embodiment but can be modified and improved properly. Also, the material, shape, dimension, number, arrangement position and the like of the respective composing elements of the above embodiment are arbitrary but not limitative so long as they can attain the invention.

For example, in the above embodiment, the first part is the connector housing and the second part is the spacer. However, they may also be reversed. That is, the lock arm 63 may also be provided on the connector housing 10 and the lock projection (that is, the lock projection 43) on the spacer 60.

Here, the characteristics of the above embodiment of the resin molded parts locking mechanism of the invention are described briefly and collectively in the following items [1]~[3].

[1] A resin molded parts locking mechanism, comprising: a lock projection (43) provided on a first part (10); and, a lock arm (63) provided on a second part (60) to be combined with the first part (10), whereby, by moving the second part (60) in a specific straight line direction with respect to the first part (10), the lock arm (63) is engaged with the lock projection (43), wherein the lock arm (63) is formed as a cantilever-like elastic arm which has a fixed rear end in the moving direction of the second part (60) with respect to the first part (10) and a free front end in the moving direction, can be deflected in a direction orthogonal to the moving direction, and also has, at a position on the free end side on one side surface in the deflecting direction, an engagement projection (64) engageable with the lock projection; the first part (10) has a first wall surface (33) extending along the moving direction of the lock arm (63) to cross orthogonally the deflecting direction of the lock arm (63), being opposed to one side surface in the deflecting direction of the lock arm (63), and having the lock projection (43); the lock projection (43) has, in its front surface opposed to the moving direction of the lock arm (63), an inclined surface (43*a*) which, when the engagement projection (64) of the lock arm (63) climbs it with movement of the second part (60), deflects the lock arm (63) gradually in a direction to part from the first wall surface (33), and, in its back surface opposed to the front surface, a lock wall (43*b*) which, when the engagement projection (64) overruns the top of the lock projection (43) and the lock arm (63) returns from its deflected state to its initial position, is opposed to and engaged with the lock wall (64*b*) of the engagement projection (64) of the lock arm (63), thereby preventing the second part (60) from moving oppositely to the moving direction; the first part (10) also has a second wall surface (34) opposed to the first wall surface (33) across the lock arm (63); the lock arm (63) also has, between the fixed end and the engagement projection (64) on the other side surface in the deflecting direction, a pressing projection (65) which, when the engagement projection (64) of the lock arm (63) climbs the inclined surface of the lock projection (43) and the lock arm (63) is thereby deflected in a direction to part from the first wall surface (33), presses the second wall surface (34) to give the lock arm (63) a pressing force opposite to the deflecting direction, thereby enhancing the substantial flexural rigidity of the lock arm (63); and, the second wall surface (34) has an opening (48) which, when, with movement of the second part (60), the engagement projection (64) of the lock arm (63) starts to climb the inclined surface of the lock projection (43) to thereby start to deflect the lock arm (63) in a direction to approach the second wall surface (34), stores the pressing projection (65) therein and, when, with further movement of the second part (60), the engagement projection (64) of the lock arm (63) has climbed the inclined surface of the lock projection (43) and is going to reach the top of the lock projection (43), due to pressing slide contact of the pressing projection (65) with the edge (48*a*) thereof, gives the lock arm (63) a pressing force opposite to the deflecting direction.

A resin molded parts locking mechanism according to the item [1], wherein the first part (10) is a connector housing (10), and the second part (60) is a spacer (60) for locking a terminal inserted into the terminal housing chamber (20) of the connector housing (10); the spacer (60) can be inserted orthogonally to the insertion direction of the terminal into the terminal housing chamber; the connector housing (10) secures the housing space (30) for the spacer (60); the housing space (30) has, in a portion thereof, an insertion space (32) having the first wall surface (33) and second wall surface (34) as opposed walls for inserting the lock arm (63); the first wall surface (33) is formed inside the insertion space, whereas the second wall surface (34) is formed outside the insertion space; and, the first wall surface (33) includes, as the above lock projection (43), a lock projection (43) for locking the spacer (60) in a position for restricting the insertion-direction movement of the terminal, and, in front of the lock projection (43) in the insertion direction of the lock arm (63), a temporary lock projection (41), when engaged with the engagement projection (64) of the lock arm (63), for locking the spacer (60) temporarily in a position allowing the insertion-direction movement of the terminal.

[3] A resin molded parts locking mechanism according to the above item [2], wherein the opening (48) is formed at a position capable of visually confirming, through the opening (48), the pressing projection (65) of the lock arm (63) temporarily locked.

The invention is based on Japanese Patent Application (JPA 2012-197733) filed on Sep. 7, 2012 and thus the contents thereof are incorporated herein for reference.

Industrial Applicability

The invention is advantageous in providing a resin molded parts locking mechanism which can give an operator a strong impression about the feeling of lock attainment and can enhance the effect of preventing removal of parts on transportation and the like.

REFERENTIAL SIGNS LIST

10: connector housing (first part)
33: first wall surface
34: second wall surface
41: temporary lock projection
43: lock projection (lock projection)
43*a*: inclined surface
43*b*: lock wall
48: opening
48*a*: edge
60: spacer (second part)
63: lock arm
64: engagement projection
64*b*: lock wall
65: pressing projection

The invention claimed is:

1. A resin molded parts locking mechanism, comprising:

a lock projection provided on a first part and a lock arm provided on a second part to be combined with the first part, whereby, by moving the second part in a specific straight line direction with respect to the first part, the lock arm is engaged with the lock projection, wherein the lock arm is formed as a cantilever-like elastic arm which has a fixed rear end in the moving direction of the second part with respect to the first part and a free front end in the moving direction, can be deflected in a direction orthogonal to the moving direction, and also has, at a position on the free end side on one side surface in the deflecting direction, an engagement projection engageable with the lock projection;

the first part has a first wall surface extending along the moving direction of the lock arm to cross orthogonally the deflecting direction of the lock arm, being opposed to one side surface in the deflecting direction of the lock arm, and having the lock projection;

the lock projection has, in its front surface opposed to the moving direction of the lock arm, an inclined surface which, when the engagement projection of the lock arm climbs it with the movement of the second part, deflects the lock arm gradually in a direction to part away from the first wall surface, and, in its back surface opposed to the front surface, a lock wall which, when the engagement projection overruns the top of the lock projection and the lock arm returns from its deflected state to its initial position, is opposed to and engaged with the lock wall of the engagement projection of the lock arm, thereby preventing the second part from moving oppositely to the moving direction;

the first part has a second wall surface opposed to the first wall surface across the lock arm;

the lock arm also has, between the engagement projection on the other side surface in the deflecting direction and the fixed end, a pressing projection which, when the engagement projection of the lock arm climbs the inclined surface of the lock projection and the lock arm is thereby deflected in a direction to part from the first wall surface, presses the second wall to give the lock arm a pressing force opposite to the deflection direction, thereby enhancing the substantial flexural rigidity of the lock arm; and the second wall has an opening which, when, with movement of the second part, the engagement projection of the lock arm starts to climb the inclined surface of the lock projection to thereby start to deflect the lock arm in a direction to approach the second wall surface, stores the pressing projection therein and, when, with further movement of the second part, the engagement projection of the lock arm has climbed the inclined surface of the lock projection and is going to reach the top of the lock projection, allows the pressing projection to be slide contacted with an edge of the opening while pressing the edge, thereby giving the lock arm a pressing force opposite to the deflecting direction.

2. The resin molded parts locking mechanism according to claim 1, wherein the first part is a connector housing, and the second part is a spacer for locking a terminal inserted into the terminal housing chamber of the connector housing;

the spacer can be inserted orthogonally to the insertion direction of the terminal into the terminal housing chamber;

the connector housing secures the housing space for the spacer;

the housing space has, in a portion thereof, an insertion space having the first wall surface and second wall surface as opposed walls for inserting the lock arm;

the first wall surface is formed inside the insertion space, whereas the second wall surface is formed outside the insertion space; and the first wall surface includes, as the above lock projection, a lock projection for locking the spacer in a position for restricting the insertion-direction movement of the terminal, and, in front of the lock projection in the insertion direction of the lock arm, a temporary lock projection, when engaged with the engagement projection of the lock arm, for locking the spacer temporarily in a position allowing the insertion-direction movement of the terminal.

3. The resin molded parts locking mechanism according to claim 2, wherein the opening is formed at a position capable of visually confirming, through the opening, the pressing projection of the lock arm temporarily locked.

* * * * *